US009341005B2

(12) United States Patent
Müller et al.

(10) Patent No.: US 9,341,005 B2
(45) Date of Patent: May 17, 2016

(54) HANDLE DEVICE

(75) Inventors: Dirk Müller, Essen (DE); Mario Christensen, Mülheim (DE); Stefan Mönig, Schwelm (DE); Christof Brauner, Essen (DE); Martin Witte, Ahaus (DE); Norbert Heller, Viersen (DE)

(73) Assignee: HUF HULSBECK & FURST GMBH & CO., Velbert (DE)

( * ) Notice: Subject to any disclaimer, the term of this patent is extended or adjusted under 35 U.S.C. 154(b) by 135 days.

(21) Appl. No.: 13/502,813

(22) PCT Filed: Sep. 18, 2010

(86) PCT No.: PCT/DE2010/001108
§ 371 (c)(1),
(2), (4) Date: Apr. 19, 2012

(87) PCT Pub. No.: WO2011/047648
PCT Pub. Date: Apr. 28, 2011

(65) Prior Publication Data

US 2012/0205925 A1 Aug. 16, 2012

(30) Foreign Application Priority Data

Oct. 20, 2009 (DE) ..... 10 2009 045 843

(51) Int. Cl.
*E05B 77/04* (2014.01)
*E05B 85/10* (2014.01)

(52) U.S. Cl.
CPC ..... *E05B 77/04* (2013.01); *E05B 85/107* (2013.01); *E05B 85/103* (2013.01); *Y10T 292/57* (2015.04)

(58) Field of Classification Search
CPC ..... E05B 85/16; E05B 63/0056; E05B 77/04; E05B 85/107; E05B 85/103; Y10T 292/57
USPC ..... 292/1, 336.3, 201, 216, DIG. 23, 292/DIG. 31, DIG. 62; 16/110.1, 412, 413, 16/415, 416
See application file for complete search history.

(56) References Cited

U.S. PATENT DOCUMENTS 3,153,553 A * 10/1964 Sandor ..... 292/336.3
3,544,148 A 12/1970 Sandor (Continued)

FOREIGN PATENT DOCUMENTS

DE 40 02 963 C1 7/1991
DE 103 09 821 A1 9/2004

(Continued)

OTHER PUBLICATIONS

International Search Report under date of Feb. 1, 2011, in connection with PCT/DE2010/001108.

*Primary Examiner* — Kristina Fulton
*Assistant Examiner* — Nathan Cumar
(74) *Attorney, Agent, or Firm* — Quarles & Brady LLP

(57) ABSTRACT

The invention relates to a handle device for a lock unit (7) of a vehicle, comprising a handle part (10) which is movably mounted relative to a door (5) of the vehicle, a locking unit (40) for preventing unintentional opening of the door (5) caused by accelerations acting upon the handle part (10), especially accelerations such as they act upon the vehicle during a crash, the locking unit (40) being displaceable between a locking position (1) and a release position (2), and a movement of the handle part (10) being enabled in the release position (2) and a movement of the handle part (10) being disabled in the locking position (1). The invention is characterized in that an actuating unit (50) is actively connected to the locking unit (40) such that the locking unit (40) can be brought from the locking position (1) into the release position (2) when the actuating unit (50) is activated.

29 Claims, 6 Drawing Sheets

(56) References Cited

U.S. PATENT DOCUMENTS

Figure 1:
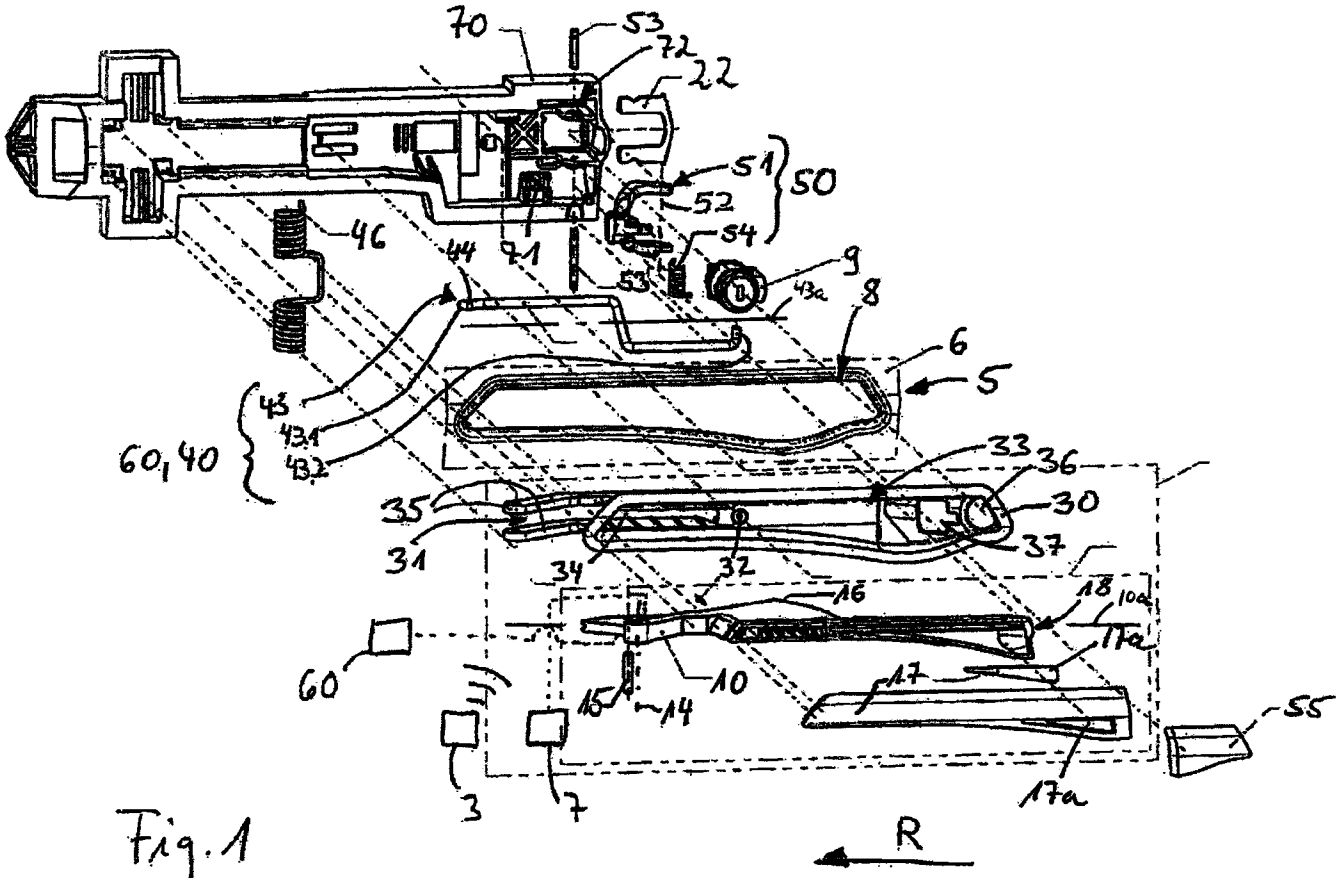

| | | | | |
|---|---|---|---|---|
| 6,158,788 | A | 12/2000 | Ikeda et al. | |
| 7,168,755 | B2 * | 1/2007 | Munezane | 296/152 |
| 7,201,405 | B2 * | 4/2007 | Le et al. | 292/93 |
| 7,543,863 | B2 * | 6/2009 | Herbert et al. | 292/336.3 |
| 8,544,904 | B2 * | 10/2013 | Kindig | 292/336.3 |
| 2002/0180220 | A1 * | 12/2002 | Bacon | 292/336.3 |
| 2007/0069531 | A1 * | 3/2007 | Herbert et al. | 292/336.3 |
| 2011/0266816 | A1 * | 11/2011 | Kindig | 292/336.3 |
| 2012/0205924 | A1 * | 8/2012 | Muller et al. | 292/336.3 |
| 2012/0216582 | A1 * | 8/2012 | Muller et al. | 70/91 |
| 2012/0274088 | A1 * | 11/2012 | Lennhoff et al. | 292/336.3 |

FOREIGN PATENT DOCUMENTS

| | | | |
|---|---|---|---|
| DE | 10309821 | * | 9/2004 |
| DE | 10 2004 036663 | * | 2/2006 |
| DE | 10 2004 03663 | A1 | 3/2006 |
| DE | 10 2004 036663 | * | 3/2006 |
| DE | 10 2008 028 391 | A1 | 12/2009 |
| EP | 1 607 555 | A2 | 12/2005 |
| EP | 1 985 784 | A1 | 10/2008 |
| EP | 1 950 366 | B1 | 1/2010 |
| FR | 1 035 351 | A | 8/1953 |
| FR | 2948402 | * | 7/2009 |

* cited by examiner

HANDLE DEVICE

CROSS-REFERENCE TO RELATED APPLICATIONS

This application claims priority to PCT International Application No. PCT/DE2010/001108 filed on Sep. 18, 2010, which claims priority to German Patent Application No. 10 2009 045 843.3 filed on Oct. 20, 2009, both of which are fully incorporated by reference herein.

The invention relates to a handle device for a locking device of a vehicle, with a handle part which is mounted movably with respect to a door of the vehicle, and a blocking unit for preventing unintentional opening of the door as a consequence of the action of accelerations acting on the handle part, the accelerations acting on the vehicle in particular in the event of an accident, wherein the blocking unit can be displaced between a locking position and a release position, wherein movement of the handle part is possible in the release position and movement of the handle part is blocked in the locking position. Furthermore, the invention relates to a method for operating a handle device.

It is known that a blocking unit is used as a crash interlock in a handle device. For example, it is disclosed in DE 199 49 119 A1 that mass elements of a blocking unit are used on account of their mass inertia to secure vehicle doors in the event of an accident. In this connection, a mass element is arranged in such a manner that it acts on the blocking unit in the event of accelerations occurring, and therefore unintentional opening of the door is prevented. The blocking unit consists in this case of a loosely arranged mass element which moves a pivotable blocking element in the event of forces occurring in an accident, thus blocking movement of the vehicle handle. According to this prior art, the blocking unit is always in a release position in which the handle part can be actuated, in particular pivoted, by the user. Only when accelerations occur on the handle part is the blocking unit briefly brought into the locking position thereof via the mass element, thus effectively blocking movement of the handle part. It has been shown as a disadvantage that a reliably functioning blocking unit with mass elements is complicated to install. At the same time, the weight of the entire arrangement is increased by the use of mass elements. It has also turned out that the provision of mass elements in the blocking unit cannot by itself fully prevent a vehicle door from being opened in the event of a side impact in boundary situations.

It is the object of the present invention to provide a handle device and a method for operating a handle device, wherein the abovementioned disadvantages are avoided and, in particular, the security of the handle device is increased without there being the risk of the door unintentionally opening in the event of accelerations acting on the handle part.

In order to achieve this object, a handle device with the features of claim 1 is proposed. Preferred developments are explained in the dependent claims. In addition, a method as claimed in claim 21 is proposed in order to achieve this object. Corresponding developments are proposed in dependent claims 22 to 29.

For this purpose, it is provided according to the invention that an actuating unit is provided, said actuating unit being operatively connected to the blocking unit in such a manner that the blocking unit can be brought from the locking position into the release position via an activation of the actuating unit.

The essential core of this invention is that the handle device is always secured by the blocking unit. This means that the blocking unit is consistently in the locking position thereof and therefore prevents unintentional opening of the door. The door can only be opened if the actuating unit is activated, as a result of which the blocking unit is temporarily brought from the locking position thereof into the release position. In the release position of the blocking unit, the user can actuate the handle part, in particular can trigger an opening of the vehicle door by pulling on the handle part.

In one possible embodiment of the invention, the blocking unit can be brought into the respective position thereof via manual activation of the actuating unit. Activation can take place, for example, merely via approaching the actuating unit. For this approach, a capacitive sensor, for example, can be provided on the handle device, in particular in the actuating unit, said sensor detecting a corresponding approach. As an alternative, touching of the actuating unit by the user is conceivable, as a result of which the actuating unit is activated. It is likewise conceivable for the actuating unit to be brought out of the rest position thereof, in particular to be pressed in and/or pivoted by the user. The activation options just described, in particular manual activation of the actuating unit, have the consequence that the blocking unit, which is operatively connected to the actuating unit, can be brought into the respective position thereof, in particular locking position and release position. For example, if it is desirable for the user to want to get into the locked and closed motor vehicle, the blocking unit, which is always in the locking position thereof, can be released via the described activation of the actuating unit, as a result of which the blocking unit is shifted into the release position thereof, and therefore the door can be opened by the user.

It is likewise conceivable for the actuating unit to be activated via an ID transmitter which can be triggered by the user at a defined distance from the handle device. In this connection, it is conceivable for the locking device to be integrated in a security system functioning without a key, in particular in an access and/or driving authorization control system which is in data communication with the mobile ID transmitter. Via a conscious action of the user, in particular at the ID transmitter and/or at the handle device, an identification check can be carried out between the ID transmitter and the security system. Given a positive identification, the blocking unit can be brought from the locking position thereof into a release position.

It is likewise possible for the blocking unit to be coupled to the handle part in such a manner that the blocking unit moves the handle part by manual activation of the actuating unit. In this connection, provision can be made for the handle part to be movable between a rest position and an operating position, wherein, in particular, the handle part lies virtually flush with the outer side of the door in the rest position and, in the operating position, protrudes out of the outer side of the door in the manner of a projection, and, in the operating position, the handle part is actuable manually in order to open the door and/or in order to activate the locking device, in particular in order to open the lock of the locking device. The wind noises are advantageously greatly reduced by the virtually flush arrangement of the handle part with the outer side of the door. In addition, in the rest position of the handle part, the entire handle device is virtually recessed in the door and is therefore not visible, thus virtually preventing soiling of the handle part. Furthermore, a protruding prior art handle also involves the risk of injury in certain boundary situations, which risk is virtually eliminated with a handle part arranged virtually flush with the outer side of the door.

The blocking unit advantageously constitutes a crash interlock in the event of any accelerations which act on the handle part and which arise, for example, in the event of a side impact. Furthermore, the blocking unit acts as a drive which can be connected both to the actuating unit and to the handle part. Corresponding activation of the actuating unit results in corresponding activation of the blocking unit which can be displaced between the locking position and the release position, wherein the blocking unit at the same time moves the handle part from the rest position into the operating position.

The blocking unit advantageously always adopts the locking position thereof, wherein the blocking unit is brought into the release position only for the movement of the handle part from the rest position into the operating position. Provision may likewise be made for the handle part to be able to be brought into a first and a second operating position, wherein the handle part, in the second operating position thereof, protrudes further from the outer side of the door than in the first operating position thereof. After the actuating unit has been activated and the handle part moved into the first operating position by the blocking unit, the user can actuate the handle part, in particular can exert a corresponding tensile force on the handle part, in order to move the handle part from the first operating position thereof into the second operating position, in particular in order to pivot the handle part about an axis of rotation. The effect which can be achieved by this is that, during the movement from the first operating position into the second operating position of the handle part, the locking device which is operatively connected to the handle part is activated, as a result of which the lock of the locking device is opened and therefore the user can open the door. The handle part is preferably operatively connected to the locking device, in particular to the lock, with a force transmission element. The force transmission element may be, for example, a Bowden cable or a rod which correspondingly activates and opens the lock of the locking device by transfer of the handle part from the first operating position into the second operating position. Of course, instead of a force transmission element, it is likewise conceivable for an electric component, in particular a switch, to be activated for the transfer of the handle part from the first operating position thereof into the second operating position, said switch subsequently correspondingly activating the locking device, as a result of which the lock can be opened and/or closed.

A measure improving the invention can make provision for the blocking unit to have a blocking element, wherein, in the locking position of the blocking unit, the blocking element adopts a first position and engages in the handle part and, in the release position, the blocking element is in a second position and is detached from the handle part. As an alternative, it is conceivable for the blocking unit to have a blocking element, wherein, in the locking position of the blocking unit, the blocking element adopts a first position and engages in the handle part, wherein, during the shifting of the blocking unit into the release position thereof, the blocking element moves into a second position, and wherein the blocking element acts on the handle part in such a manner that the handle part moves from the rest position thereof into the operating position. In addition, it is conceivable for the blocking element to have a first and a second end, wherein the first end interacts with the handle part and the second end is arranged on the actuating unit.

The blocking unit can be designed with a security contour which ensures that the blocking element can be reliably moved between the first and the second position thereof, and in particular ensures that the blocking element reliably passes back from the second position thereof into the first position, again engaging in the handle part, when the handle part moves back from the operating position thereof into the rest position thereof.

The handle part can be moved from the operating position into the rest position, for example, consciously by means of a corresponding action of the user, for example by the user reactivating the actuating unit. It is likewise conceivable that, after the user has entered the vehicle, this action is recognized via a certain sensor system which triggers a movement of the handle part into the rest position. It is conceivable for a movement back of the handle part into the rest position to be able to be triggered via actuation of the ID transmitter. Alternative triggering mechanisms for guiding the handle part back into the rest position are likewise conceivable, in particular movement of the handle part into the rest position being triggered via the ignition contact of the vehicle.

According to the invention, a handle mount arranged fixedly within the door can be provided and a handle shell which is fastened to the handle mount can be arranged on the opening of the door. The handle mount is located on the inside of the door. The handle mount can have at least one bearing point for the blocking unit and/or at least one bearing point for the handle part. It is likewise conceivable for the handle shell and/or the handle mount to have a bearing for the handle part and/or for the blocking unit. A particular advantage of the invention can be the fact that the handle mount and the handle part are designed as standard components which can be used in diverse, differently configured handle device models. The handle shell and the handle part can first of all be assembled as one component in a first installation step. In this case, the handle part is mounted rotatably/pivotably on the handle shell, in particular so as to be movable about an axis of rotation of the handle shell during the movement of said handle part between the rest position and the operating position. Said module unit consisting of the handle shell and handle part is subsequently fitted into the opening of the door. In this case, the handle shell is matched in the geometrical configuration thereof so as to correspond to the opening of the door. Therefore, when inserted on the door, the handle shell conceals the door opening. At the same time, the handle shell is designed with a corresponding receptacle within which the handle part is reliably accommodated. Said module unit is fastened by the handle shell being fastened to the handle mount in a form-fitting, frictional and/or integrally bonded manner. In one possible embodiment of the invention, the handle shell is screwed to the handle mount. By means of the above-described preassembly of the handle shell with the handle part, the handle device can be swiftly and exactly installed.

In one conceivable refinement of the invention, a drive can be provided, said drive moving the blocking element in a translatory manner via a pivoting and/or rotational movement of the actuating unit. The actuating unit may, for example, conceal a locking cylinder which is operatively connected to the locking device, in particular to the lock of the locking device.

The blocking element can extend longitudinally in the direction of the vehicle, in particular can be of rod-like design, and in particular can have a defined, curved profile. In this connection, it is conceivable for the blocking element to be designed with a geometrically shaped section which makes contact with the handle part during the transfer from the rest position into the operating position.

The blocking element can have a curved profile along the extent thereof, wherein the shaped section serves to correspondingly contact the handle part during the transfer from the rest position into the operating position and therefore to press the handle part out of the door, specifically while the blocking element is moving from the first position thereof into the second position thereof.

The actuating unit is advantageously arranged rotatably on the handle mount. In addition, provision may be made for the actuating unit to have such a small mass that, in the event of and as a consequence of the action of accelerations acting on the actuating unit, the blocking unit remains in the locking position thereof. The mass of the actuating unit is designed in such a manner that, even at high accelerations which can act on the handle part and on the actuating unit, the construction of the actuating unit and of the blocking unit ensures that the blocking unit is not released from the locking position thereof.

The actuating unit and/or the handle part may be spring-loaded. In this connection, a spring element may act on the handle part. If the blocking element is moved from the first position thereof, in which the handle part is held in a locking manner in the handle shell, into the second position, in which the blocking element releases the handle part, the spring element pushes the handle part out of the rest position thereof into the operating position. As an alternative, it is conceivable for the spring element to act on the handle part in such a manner that, in the operating positions, the spring element exerts a force on the handle part in order to move the handle part back again into the rest position thereof. The spring element can advantageously be fastened to the handle mount.

According to one possible embodiment of the invention, the handle part can remain in the first operating position thereof, since the blocking element pushes with the corresponding section thereof against the handle part and prevents the handle part from moving back into the rest position thereof via the spring element acting on the handle part. If the handle part pivots from the first operating position thereof into the second operating position, the contact of the section of the blocking element with the handle part is released, and therefore the blocking element is linearly displaced back from the second position thereof into the first position thereof. If the user then releases the handle part from the second operating position, the spring element acts on the handle part in such a manner that the handle part is moved back into the rest position thereof. Upon arrival in the rest position, the blocking unit snaps or latches with the blocking element thereof into a corresponding latching opening in the handle part, as a result of which the blocking unit reaches the locking position thereof.

In addition, the object is achieved by the method for operating a handle device for a locking device of a motor vehicle, with a handle part which is mounted movably on a door of the motor vehicle, and with a blocking unit for preventing unintentional opening of the door as a consequence of the action of accelerations acting on the handle part, the accelerations acting on the vehicle in particular in the event of an accident, wherein the blocking unit can be displaced between a locking position and a release position, movement of the handle part is possible in the release position and movement of the handle part is blocked in the locking position, wherein an actuating unit is provided, said actuating unit being operatively connected to the blocking unit in such a manner that the blocking unit is brought from the locking position into the release position via an activation of the actuating unit.

The handle part is advantageously moved at the same time via activation of the actuating unit. It is likewise conceivable for the handle part to be movable between a rest position and an operating position, wherein, in particular, the handle part lies substantially flush with the outer side of the door in the rest position and, in the operating position, protrudes from the outer side of the door in the manner of a projection. In addition, provision may be made for the locking device to be activated, in particular the lock of the locking device to be opened, by manual movement of the handle part from a first operating position into a second operating position.

Provision may be made for the locking device to be integrated in a security system functioning without a key, in particular in an access and/or driving authorization control system, which is in data communication with a mobile ID transmitter, wherein, with a conscious action of the user, in particular at the ID transmitter or at the handle device, an identification check is carried out between the ID transmitter and the security system. Given a positive identification, the handle part advantageously moves from the rest position into the operating position, wherein, in particular, the locking device is activated at the same time, and in particular the locking device is brought from a locking state into a release state. In addition, the identification check can be started by activation of the actuating unit.

The lock of the locking device can be opened by manual movement of the handle part from a first operating position into a second operating position.

Figure 2:
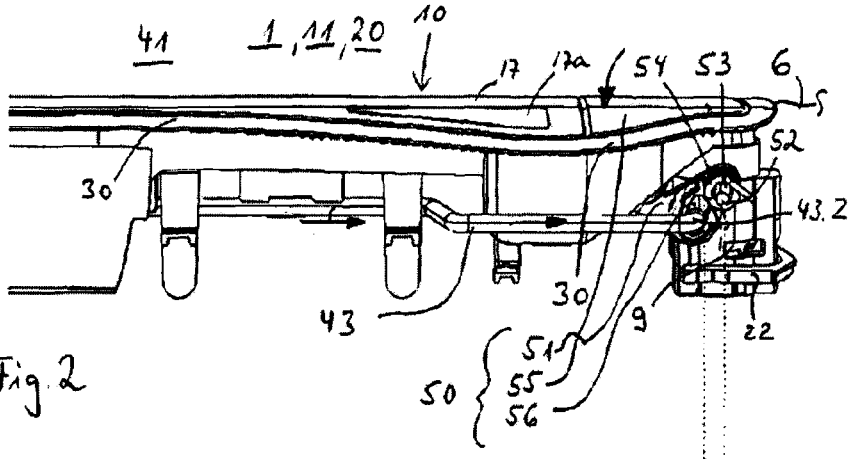
Figure 3:
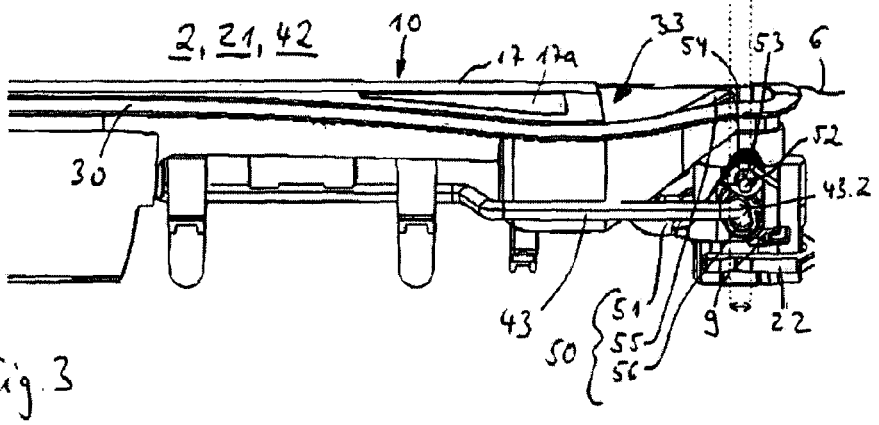
Figure 4:
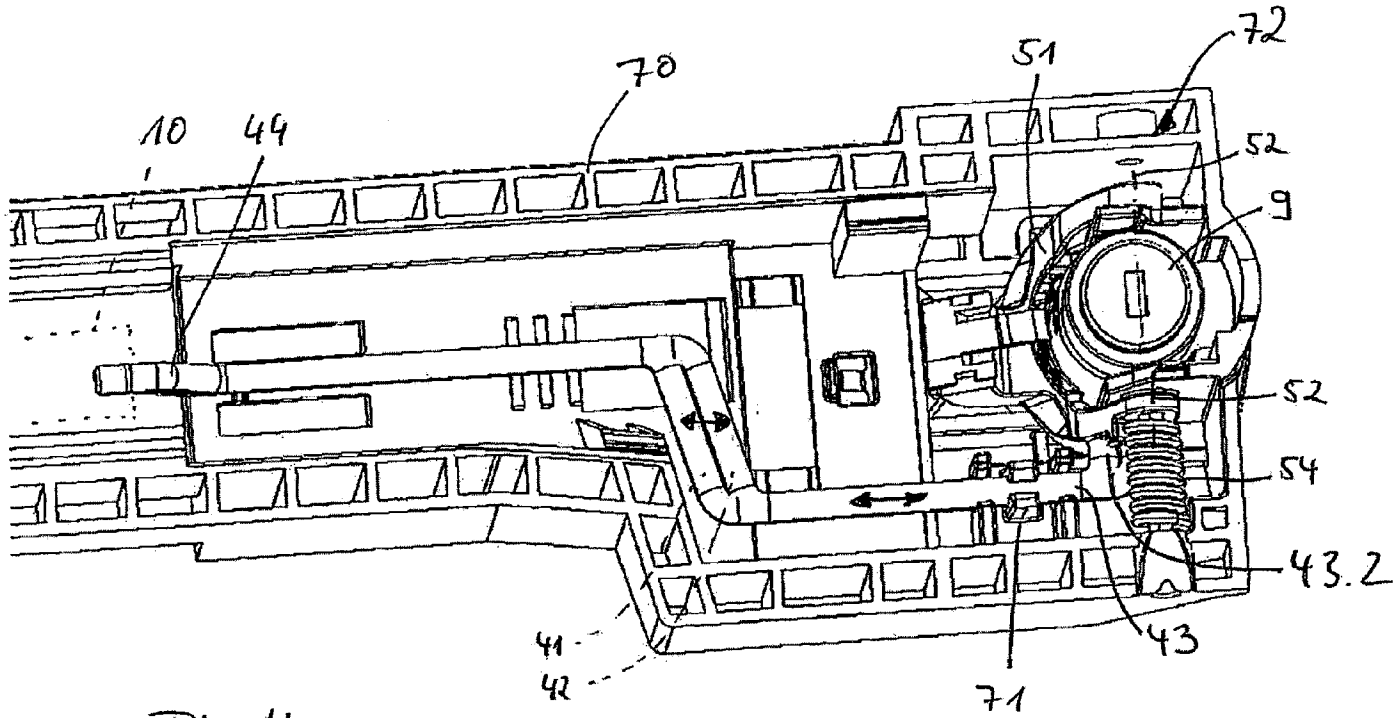
Figure 5:
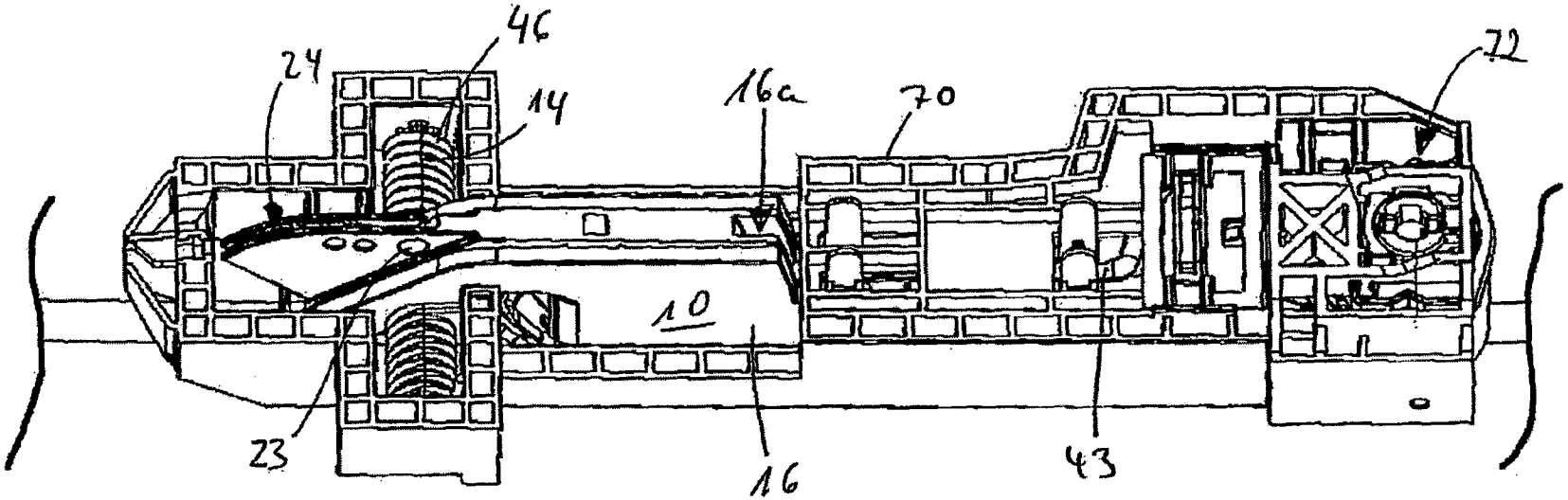
Figure 6B:
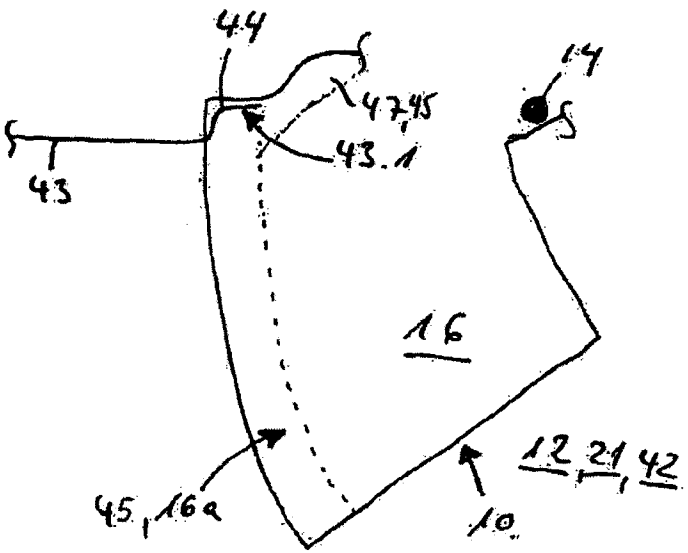
Figure 6A:
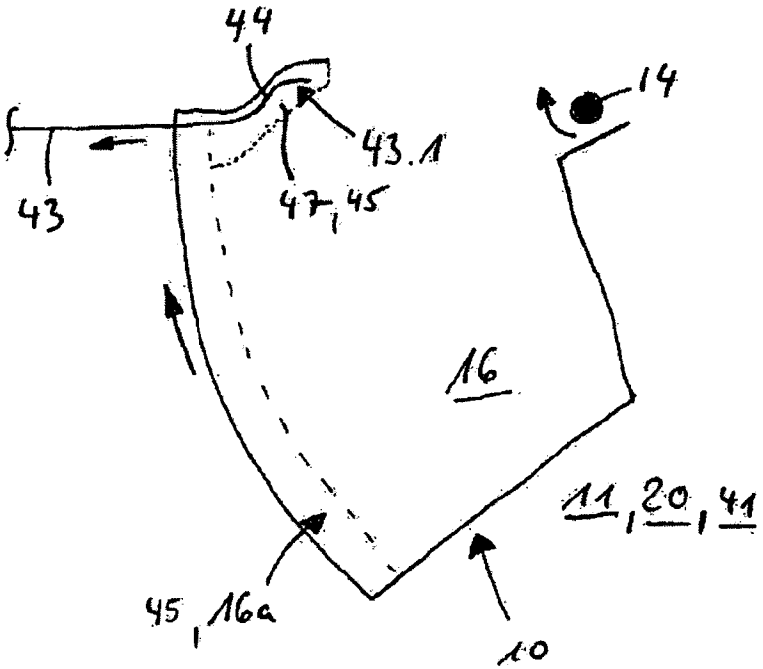
Figure 7:
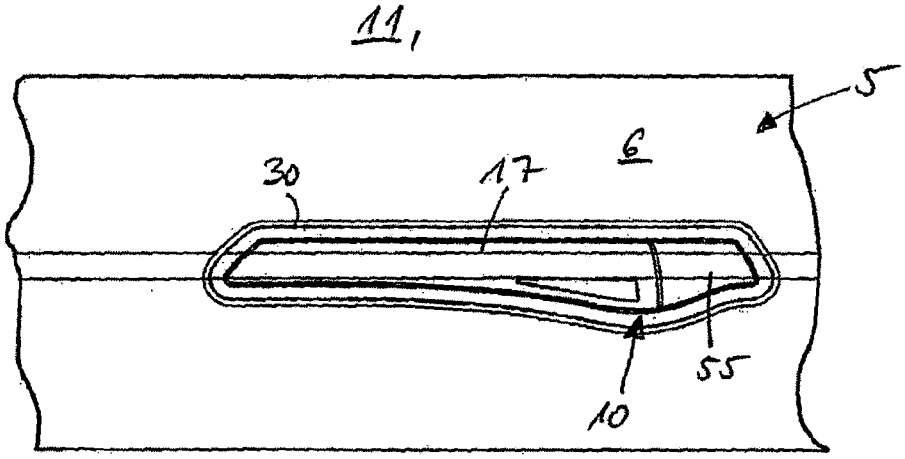
Figure 8:
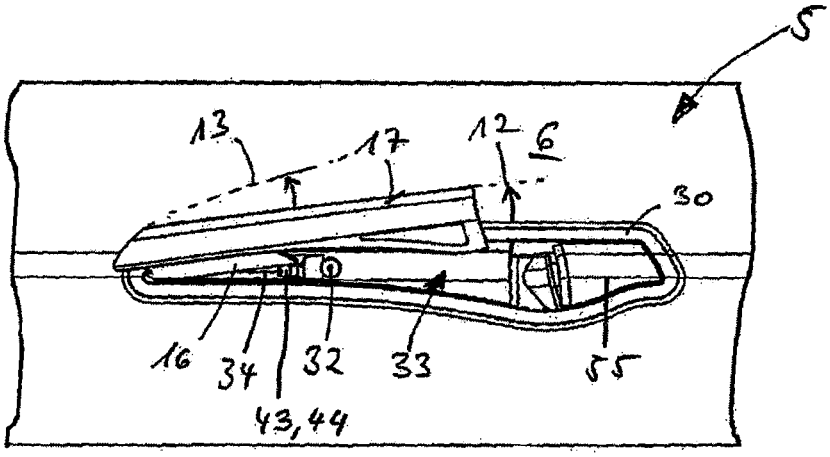

Further measures and advantages and technical features of the invention emerge from the claims, the description below and the drawings. The handle device according to the invention is illustrated in detail by a plurality of exemplary embodiments in the figures below, in which:

FIG. 1 shows an exploded illustration of a handle device according to the invention for a locking device of a vehicle, FIG. 2 shows the handle device according to FIG. 1, wherein a blocking unit which is in the locking position is provided, FIG. 3 shows the handle device according to FIG. 1, wherein the blocking unit is in a release position, FIG. 4 shows an enlarged illustration of a handle mount from FIG. 1, FIG. 5 shows a further illustration of a handle mount from FIG. 1, FIG. 6*a* shows a purely schematic illustration of a partial region of the handle part and of the blocking unit, which is in the locking position thereof, FIG. 6*b* shows the blocking unit according to FIG. 6*a*, wherein the blocking unit is in the release position, FIG. 7 shows a possible embodiment of the handle device with a handle part which is in the rest position, and FIG. 8 shows the handle part according to FIG. 7, the handle part being in an operating position.

FIG. 1 shows one possible variant embodiment of a handle device for a locking device 7 of a vehicle. The locking device 7 is illustrated purely schematically in FIG. 1. The locking device 7 is part of a security system functioning without a key, in particular of an access and/or driving authorization control system of a motor vehicle. The security system can be in data communication, for example, with an ID transmitter 3, wherein, with a conscious action of the user, in particular at the ID transmitter 3 or at the handle device, an identification check can be carried out between the ID transmitter 3 and the security system. Given a positive identification, the locking device 7 can be brought from a locking state 20 into a release state 21 (also see FIGS. 2, 3, 6*a* and 6*b*). In the release state 21, opening of the door of the motor vehicle is possible, for example, and this will be discussed in more detail below.

The handle device has a handle part 10 defining a longitudinal axis 10*a* and which is mounted movably with respect to a door 5 of the vehicle. In this case, the handle part 10 is mounted rotatably about the axis 14 thereof. The bearing pin 15 forms the axis of rotation here.

The handle part 10 can be moved between a rest position 11, which is illustrated by way of example in FIG. 7, and an operating position 12, 13, which is shown in FIG. 8. In the rest position 11, the handle part 10 is flush with the outer side 6 of the door 5. In the operating position 12, 13, the handle part 10 protrudes from the outer side 6 of the door 5 in the manner of a projection.

As can be seen from FIG. 1, a handle mount 70 is provided, the handle mount being fastened on the inside of the door 5 and likewise being illustrated in FIG. 4 and FIG. 5. In addition, the handle device has a handle shell 30 which is arranged on the opening 8 of the door 5, wherein the handle shell 30 is fastened to the handle mount 70. In the present exemplary embodiment, the handle shell 30 is fastened to the handle mount 70 via a screw connection 32.

In the rest position 11 of the handle part 10, the handle part 10 is located in a receptacle 33 of the handle shell 30. The receptacle 33 therefore completely accommodates the handle part 10 in the rest position 11 thereof. The handle part 10 has an extension 16 which extends in the direction of the handle mount 70 and through which the axis of rotation 14 runs. The extension 16 extends through a first opening 34 in the handle shell 30. The handle shell 30 furthermore has two spaced-apart webs 35 which are connected to each other by the bearing pin 15 which forms the axis of rotation 14 for the handle part 10.

In addition, the handle shell 30 has a second opening 36, and a locking cylinder 9 is accommodated within said opening 36. The locking cylinder 9 is fixed on the handle mount 10 via a fastening element 22.

A third opening 37 is furthermore provided on the handle shell 30, which opening is provided for an actuating unit 50. The actuating unit 50 has an actuating element 51 which is arranged rotatably on a bearing point 72 of the handle mount 70. In this case, the actuating element 51 has an axis of rotation 52.

The axis of rotation 52 is formed by the pins 53. In addition, the actuating element 51 is loaded by a spring element 54. Said spring element is likewise shown in FIGS. 2 and 3.

The actuating unit 50 furthermore has a cover 55 which is matched to the contour of the receiving opening 33 in the handle shell 30. In addition, the handle part 10 has a cover 17 which is directed toward the outer side 6 of the vehicle door 5 and is arranged adjacent to the cover 55. Said cover 17 also completely covers the handle part 10 and the receiving opening 33 in the handle shell 30 when the handle part 10 is in the rest position 11 thereof.

The actuating unit 50 is operatively connected to a blocking unit 40. The blocking unit 40, which prevents unintentional opening of the door 5 as a consequence of the action of accelerations acting on the handle part 10, can be displaced between a locking position 1, which is illustrated in FIG. 6*a*, and a release position 2, which is illustrated in FIG. 6*b*.

Movement of the handle part 10 is permitted in the release position 2. By contrast, movement of the handle part 10 is blocked in the locking position 1, and therefore, for example in the event of a side impact, an unintentional opening of the door 5 is effectively prevented.

According to the exemplary embodiment illustrated, the blocking unit 40 always adopts the locking position 1 thereof. The blocking unit 40 can be brought from the locking position 1 into the release position 2, which is shown in FIGS. 2 and 3, only by a conscious activation of the actuating unit 50 by the user.

According to FIG. 2 and FIG. 3, the actuating unit 50 is coupled to the blocking unit 40. In this connection, the blocking unit 40 has a blocking element 43 which is illustrated in FIGS. 1 to 5. The blocking element 43 defines a longitudinal axis 43*a* and extends longitudinally in the direction of the vehicle R and is of rod-like design. The blocking element 43 here has a defined curved profile. The blocking element 43 can be formed from a metal or else from a plastic, in particular a fiber-reinforced plastic.

The blocking element 43 has a first end 43.1 and a second end 43.2, wherein the first end 43.1 interacts with the handle part 10 which is shown in FIG. 5, FIG. 6*a* and FIG. 6*b*. The second end 43.2 of the blocking element 43 is arranged on the actuating unit 50 and is illustrated in FIGS. 2 to 4. The actuating element 51 which is pivotable about the axis 52 has an elongated hole 56 in which the second end 43.2 of the blocking element 43 engages. According to FIG. 2, the handle part 10 is in the rest position 11 thereof, and the actuating unit 50 with the cover 55 thereof is in the starting position thereof, wherein both covers 17, 55 are arranged flush with the outer side 6 of the door 5. If conscious activation of the actuating unit 50 now takes place by the cover 55 being pressed in manually, the actuating element 51 pivots about the axis 52, wherein the actuating element 51 rotates counterclockwise about the axis 52. At the same time, the blocking element 43, which is guided in the elongated hole 56, is displaced in a translatory manner to the right. The spring element 54 acts in the clockwise direction on the actuating element 51 with a defined spring force. By means of said translatory displacement of the blocking element 43 from the first position 41 thereof according to FIG. 2, in which said blocking element acts with the first end 43.1 thereof in a locking manner in the handle part 10, which is shown in FIG. 6*a*, the blocking element 43 moves owing to the described actuation of the actuating element 51 according to FIG. 3 into a second position 42 which said blocking element reaches in FIG. 3 and in FIG. 6*b* and in which said blocking element is detached from the handle part 10.

If the blocking element 43 is in the second position 42 thereof, the handle part 10 can be moved out of the secured rest position 11 thereof into an extended operating position 12, 13. The handle part 10 can be moved into the respective position 11, 12, 13 thereof via a drive 60 which is illustrated schematically in FIG. 1. In the present exemplary embodiment, the blocking unit 40, which acts as a crash interlock, is at the same time the drive 60 for a corresponding movement of the handle part 10 into the respective position 12 thereof. According to FIG. 4 and FIGS. 6*a* and 6*b*, the blocking element 43 is designed with a geometrically shaped section 44 which makes contact by means of the section 44 with the handle part 10 during the transfer from the first position 41 into the second position 42 and therefore, according to FIG. 6*a*, presses the handle part 10 in the clockwise direction about the axis 14 in the direction of the operating position 12, 13. The section 44 is likewise shown in FIG. 8, said section pressing the handle part 10 out of the door 5.

According to the exemplary embodiment illustrated in FIG. 5, the extension 16 of the handle part 10 has a groove 16*a*, wherein the first end 43.1 of the blocking element 43 projects into a latching opening 47, which is shown in FIG. 6*a*. If the described translatory movement of the blocking element 43 in the direction of the operating position 12, 13 takes place, the shaped section 44 presses against an edge region of the handle part 10 which is moved by the movement of the blocking element 43 in the clockwise direction about the axis 14 and reaches the first operating position 12 according to FIG. 6*b*.

A spring element 46, which is illustrated in FIG. 1 and FIG. 5, acts on the extension 16 in order to move the handle part 10 back again into the rest position 11 thereof. However, according to FIG. 6*b*, owing to the position of the blocking element 43, the handle part 10 is held in the first operating position 12.

According to FIG. 8, the handle part 10 can be brought from the first operating position 12 thereof into a second operating position 13, wherein the handle part 10, in the second operating position 13 thereof, protrudes further from the outer side 6 of the door 5 than in the first operating position 12 thereof. By means of manual movement of the handle part 10 from the first operating position 12 into the second operating position 13, the locking device 7 according to FIG. 1 can be correspondingly activated, as a result of which the lock of the locking device 7 is opened and therefore the user can open the door 5 of the vehicle. Upon movement of the handle part 10 about the axis 14 thereof from the first operating position 12 into the second operating position 13, the blocking element 43 remains with the first end 43.1 thereof in the groove 16*a* of the extension 16 (see FIG. 6*a* and FIG. 6*b*). It is therefore ensured that, when the handle part 10 is returned from one of the operating positions 12, 13 into the rest position 11, the blocking unit 40 reliably reaches the locking position 1 thereof, which means that the blocking element 43 reliably moves with the first end 43.1 thereof into the latching opening 47' during the return movement of the handle part 10 into the rest position 11 thereof.

The locking cylinder 9, which can be actuated, according to FIG. 3, by a key, is exposed at the same time as the movement of the actuating element 51. Blocking and unlocking of the locking device 7 and opening of the lock of the locking device 7 can likewise be obtained by actuation of the locking cylinder 9. A cavity 18 is formed within the handle part 10, and an electronic unit can be located within said cavity 18. According to FIG. 1, the cover 17 has an additional covering 17*a* which is designed to be transparent to light. A lighting element is located behind the covering 17*a*. The covering 17 serves as a light-transparent window.

According to FIG. 6*a* and FIG. 6*b*, the groove 16*a* of the extension 16 and the latching opening 47 form a security contour 45, as a result of which reliable moving back and transfer of the blocking element 43 into the first position 41 thereof and the transfer of the blocking unit 40 into the locking position 1 are ensured.

According to FIG. 5, the extension 16 of the handle part 10 is designed with a fastening opening 23. A force transmission element, here a Bowden cable, for example, can be fastened in the fastening opening 23. The Bowden cable is connected to the locking device 7 from FIG. 1, wherein an opening operation of the lock of the locking device 7 can be brought about by a corresponding movement of the handle part 10 from the first operating position 12 into the second operating position 13. The Bowden cable is guided within the guide 24 of the handle part 10.

According to FIG. 1, the handle mount 70 is designed with a bearing point 71 along which the blocking element 43 is guided. Said bearing point 71 is shown in an enlarged illustration according to FIG. 4.

Reliable linear guidance of the blocking element 43 within the handle device is obtained as a result.

According to FIG. 1, the handle shell 30 has a bearing 31, as a result of which the handle part 10 is mounted pivotably about the axis 14.

Of course, it is possible, as an alternative and/or in addition, for the blocking element 43 to execute a rotational or pivoting movement instead of a linear movement in order to move from the first position 41 into the second position 42 and vice versa.

LIST OF DESIGNATIONS

1 Locking position
2 Release position
3 ID transmitter
5 Door
6 Outer side of the door
7 Locking device
8 Opening of the door
9 Locking cylinder
10 Handle part
11 Rest position
12 Operating position, first operating position
13 Operating position, second operating position
14 Axis
15 Bearing pin
16 Extension
16 *a* Groove of the extension
17 Cover
17*a* Covering
18 Cavity
20 Locking state
21 Release state
22 Fastening element
23 Fastening opening
24 Guide
30 Handle shell
31 Bearing
32 Screw connection
33 Receptacle
34 First opening
35 Web
36 Second opening
37 Third opening
40 Blocking unit
41 First position
42 Second position
43 Blocking element
43.1 First end of the blocking element
43.2 Second end of the blocking element
44 Section of the blocking element
45 Security contour
46 Spring element
47 Latching opening
50 Actuating unit
51 Actuating element
52 Axis
53 Pin
54 Spring element
55 Cover
56 Elongated hole
60 Drive
70 Handle mount
71 Bearing point
72 Bearing point
R Direction of the vehicle

The invention claimed is:

1. A handle device for a locking device of a vehicle, said handle device comprising:

a handle part movably mountable with respect to a door of the vehicle between a rest position and an operating position, said handle part defining a handle part longitudinal axis;

an elongated blocking unit preventing unintentional opening of the door as a consequence of the action of accelerations acting on the handle part in the event of an accident, said elongated blocking unit including a blocking element having a first end and a second end, said entire blocking element being translatable along a blocking element longitudinal axis substantially parallel to said handle part longitudinal axis when said handle part is in said rest position and moving said first end between a locking position and a release position, wherein movement of the handle part is possible in the release position and movement of the handle part from said rest position is blocked in the locking position; and an actuating unit connected to the second end of the blocking element, wherein upon activation of said actuating unit, said actuating unit moves said entire blocking element along said blocking element longitudinal axis, such that the first end of said blocking element moves from the locking position into the release position.

2. The handle device as claimed in claim 1, in which the blocking unit can be brought into the release position and locking position via a manual activation of the actuating unit.

3. The handle device as claimed in claim 1, in which the blocking unit is coupled to the handle part in such a manner that the blocking unit moves the handle part by manual activation of the actuating unit.

4. The handle device as claimed in claim 1, wherein, the handle part lies virtually flush with an outer side of the door in the rest position and, in the operating position, the handle part protrudes out of the outer side of the door in the manner of a projection, and, in the operating position, the handle part is actuable manually in order to at least one of open the door and activate the locking device in order to open the lock of the locking device.

5. The handle device as claimed in claim 1, in which the blocking unit always adopts the locking position, wherein the blocking unit is in the release position only for the movement of the handle part from the rest position into the operating position.

6. The handle device as claimed in claim 1, in which the handle part has a first operating position and a second operating position, wherein the handle part, in the second operating position, the handle part protrudes further from an outer side of the door than in the first operating position.

7. The handle device as claimed in claim 1, in which the locking device is integrated in a security system functioning without a key.

8. The handle device as claimed in claim 1, wherein, in the locking position, the blocking element adopts a first position and engages in the handle part and, in the release position, the blocking element is in a second position and is detached from the handle part.

9. The handle device as claimed in claim 1, in which the blocking element is movable between a first position and a second position, wherein, in the locking position, the blocking element adopts the first position and engages in the handle part, wherein, during movement of the blocking unit into the release position, the blocking element moves into the second position, and wherein the blocking element acts on the handle part in such a manner that the handle part moves from the rest position into the operating position.

10. The handle device as claimed in claim 9, including a drive connected to the blocking element, the blocking element being movable between the first position and the second position, and wherein, the drive comprises the actuating unit.

11. The handle device as claimed in claim 10, characterized in that the drive moves the blocking element in a translatory manner along said blocking element longitudinal axis via at least one of a pivoting and rotational movement of the actuating unit.

12. The handle device as claimed in claim 8, wherein the first end interacts with the handle part and the second end is arranged on the actuating unit.

13. The handle device as claimed in claim 1, including a handle mount arranged fixedly within the door, and a handle shell fastened to the handle mount is arranged on an opening of the door.

14. The handle device as claimed in claim 13, in which at least one of the handle shell and the handle mount forms a bearing for the handle part.

15. The handle device as claimed in claim 13, in which the actuating unit is arranged rotatably on the handle mount.

16. The handle device as claimed in claim 13, in which the handle mount has at least one bearing point for the blocking unit.

17. The handle device as claimed in claim 8, in which the blocking element extends longitudinally in the direction of the vehicle in the manner of a rod having a defined, curved profile.

18. The handle device as claimed in claim 1, in which the actuating unit has a sufficiently small mass that, in the event of and as a consequence of the action of accelerations acting on the actuating unit, the blocking unit remains in the locking position.

19. The handle device as claimed in claim 8, in which the blocking element has a geometrically shaped section which engages the handle part during the transfer from the first position into the second position.

20. The handle device as claimed in claim 1, in which at least one of the actuating unit and the handle part is spring-loaded.

21. A method for locking and unlocking a door of a vehicle, the method comprising:

movably mounting a handle part with respect to a door of the vehicle, said handle part defining a handle part longitudinal axis, wherein the handle part is movable between a rest position and an operating position, movably mounting an elongated blocking unit for preventing unintentional opening of the door as a consequence of the action of accelerations acting on the handle part, the accelerations acting on the vehicle in particular in the event of an accident, the elongated blocking unit including a blocking element having first end and a second end, said entire blocking element being translatable along a blocking element longitudinal axis substantially parallel to said handle part longitudinal axis when said handle part is in said rest position and said first end being movable between a locking position wherein the handle part is blocked and a release position in which the handle part is movable from said rest position, and activating an actuating unit connected to the second end of the blocking element to move said entire blocking element along said longitudinal axis to move the first end of said blocking element from the locking position into the release position.

22. The method as claimed in claim 21, including moving the handle part via activation of the actuating unit at the same time as moving the blocking unit.

23. The method as claimed in claim 21, wherein, the handle part lies substantially flush with the outer side of the door in the rest position and, in the operating position, protrudes out of the outer side of the door.

24. The method as claimed in claim 23, including manually moving the handle part from a first operating position into a second operating position to open a lock of the locking device.

25. The method as claimed in claim 21, in which the locking device is integrated in a security system functioning without a key, said security system being in data communication with a mobile ID transmitter, wherein, with a conscious action of the user, in particular at the ID transmitter or at the handle device, an identification check is carried out between the ID transmitter and the security system, said method including carrying out an identification check between the ID transmitter and the security system.

26. The method as claimed in claim 25, in which, given a positive identification from the identification check, the method includes moving the handle part from the rest position into the operating position, and at the same time moving the locking device from a locking state into a release state.

27. The method as claimed in claim 25, in which the identification check is started by activation of the actuating unit.

28. The handle device as claimed in claim 1, in which the actuating unit engages said second end of the blocking element to move said entire blocking element along said blocking element longitudinal axis.

29. The method as claimed in claim 21, in which said actuating unit engages said second end of said blocking element to move said entire blocking element along said blocking element longitudinal axis to move the first end of said blocking element from the locking position into the release position.

* * * * *